US009398389B2

(12) United States Patent
Naylor

(10) Patent No.: US 9,398,389 B2
(45) Date of Patent: Jul. 19, 2016

(54) APPARATUS FOR SECURING COMPONENTS IN AN ELECTRET CONDENSER MICROPHONE (ECM)

(71) Applicant: Knowles Electronics, LLC, Itasca, IL (US)

(72) Inventor: Felix Matthew Naylor, Chicago, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 7 days.

(21) Appl. No.: 14/273,041

(22) Filed: May 8, 2014

(65) Prior Publication Data

US 2014/0334646 A1 Nov. 13, 2014

Related U.S. Application Data

(60) Provisional application No. 61/822,590, filed on May 13, 2013.

(51) Int. Cl.
*H04R 31/00* (2006.01)
*H04R 19/01* (2006.01)

(52) U.S. Cl.
CPC ..... *H04R 31/00* (2013.01); *H04R 19/016* (2013.01); *H04R 2499/11* (2013.01)

(58) Field of Classification Search
CPC .... H04R 19/016; H04R 19/04; H04R 19/005; H04R 31/00; H04R 1/04; H04R 3/00
USPC ..... 381/174
See application file for complete search history.

(56) References Cited

U.S. PATENT DOCUMENTS

| | | | |
|---|---|---|---|
| 4,063,050 | A | 12/1977 | Carlson et al. |
| 4,316,062 | A | 2/1982 | Beveridge |
| 4,701,640 | A | 10/1987 | Flygstad et al. |
| 4,730,283 | A | 3/1988 | Carlson et al. |
| 4,764,690 | A | 8/1988 | Murphy et al. |
| 4,815,560 | A | 3/1989 | Madaffari |
| 5,335,286 | A | 8/1994 | Carlson |

(Continued)

FOREIGN PATENT DOCUMENTS

| | | | |
|---|---|---|---|
| CN | 102582073 | A | 7/2012 |
| EP | 0533284 | A1 | 3/1993 |

(Continued)

OTHER PUBLICATIONS

International Search Report and Written Opinion for PCT/US2014/037481, dated Sep. 12, 2014, 10 pages.

*Primary Examiner* — Mark Blouin
(74) *Attorney, Agent, or Firm* — Fitch, Even, Tabin & Flannery LLP

(57) ABSTRACT

An Electret Condenser Microphone (ECM) motor apparatus includes a diaphragm ring support structure, a charge plate, and at least one stitch. The diaphragm ring support structure defines an opening there through. The charge plate is disposed within the opening. The at least one stitch is coupled to the diaphragm ring support structure to the charge plate. The diaphragm is disposed adjacent to and in a generally parallel relationship to the charge plate. The stitch is configured to hold the charge plate and the diaphragm ring, and the stitch is configured to maintain a constant or nearly constant distance between the charge plate and the diaphragm in the absence of sound energy.

17 Claims, 4 Drawing Sheets

(56) References Cited

U.S. PATENT DOCUMENTS

| | | | | |
|---|---|---|---|---|
| 5,408,534 | A | 4/1995 | Lenzini | |
| 5,548,658 | A | 8/1996 | Ring | |
| 6,532,293 | B1 | 3/2003 | Collins | |
| 6,654,473 | B2 | 11/2003 | Collins | |
| 6,684,484 | B2 | 2/2004 | Collins | |
| 6,704,427 | B2 | 3/2004 | Kearey | |
| 7,136,500 | B2 | 11/2006 | Collins | |
| 7,184,563 | B2 | 2/2007 | Collins | |
| 7,260,230 | B2 | 8/2007 | Feng | |
| 8,085,956 | B2 | 12/2011 | Jennings | |
| 8,144,898 | B2 | 3/2012 | Feng | |
| 8,150,078 | B2 * | 4/2012 | Izuchi | H04R 19/016 381/184 |
| 8,229,140 | B2 | 7/2012 | Jennings | |
| 8,401,209 | B2 | 3/2013 | Beard | |
| 8,542,852 | B2 * | 9/2013 | Kageyama | B06B 1/0292 381/173 |
| 2003/0034536 | A1 | 2/2003 | Scheeper et al. | |
| 2006/0140423 | A1 * | 6/2006 | Tanabe | H04R 19/016 381/174 |
| 2006/0205244 | A1 * | 9/2006 | Shigeno | H04R 19/016 439/67 |
| 2006/0245606 | A1 | 11/2006 | Hsieh et al. | |
| 2007/0258605 | A1 * | 11/2007 | Tsuchiya | H04R 31/00 381/174 |
| 2008/0232631 | A1 | 9/2008 | Loeppert et al. | |
| 2009/0097687 | A1 | 4/2009 | Collins | |
| 2009/0226012 | A1 | 9/2009 | Izuchi et al. | |
| 2011/0233692 | A1 | 9/2011 | Inoda et al. | |
| 2013/0094676 | A1 * | 4/2013 | Muraoka | H04R 19/016 381/174 |
| 2014/0334646 | A1 | 11/2014 | Naylor et al. | |

FOREIGN PATENT DOCUMENTS

| | | | |
|---|---|---|---|
| JP | 2003-209899 | A | 7/2003 |
| JP | 2007-295308 | A | 11/2007 |
| WO | 93/18627 | A1 | 9/1993 |

* cited by examiner

APPARATUS FOR SECURING COMPONENTS IN AN ELECTRET CONDENSER MICROPHONE (ECM)

CROSS REFERENCE TO RELATED APPLICATIONS

This patent claims benefit under 35 U.S.C. §119 (e) to U.S. Provisional Application No. 61/822,590 entitled "Apparatus for Securing Components in an Electret Condenser (ECM)" filed May 13, 2013, the content of which is incorporated herein by reference in its entirety.

TECHNICAL FIELD

This application relates to acoustic devices and, more specifically, securing the internal components of these devices.

BACKGROUND OF THE INVENTION

Various types of acoustic devices exist and one such type of device is a microphone. In one example, the Electret Condenser Microphone (ECM) is being used in devices such as cellular phones, video cameras, studio performance microphones, and headphones to mention a few examples.

In the case of an ECM, sound energy enters through a sound port and vibrates a diaphragm and this action creates a corresponding change in electrical potential (voltage) between the diaphragm and a charge plate disposed near the diaphragm. This voltage represents the sound energy that has been received. Typically, the voltage is then transmitted to an electric circuit (e.g., an integrated circuit such as an application specific integrated circuit (ASIC)). Further processing of the signal may be performed on the electrical circuit. For instance, amplification or filtering functions may be performed on the voltage signal at the integrated circuit.

In order for the diaphragm and charge plate combination to function properly, they need to be secured within the microphone. If, for example, the distance separating them changes in an unexpected way (in the absence of the diaphragm moving in response to sound energy), then the microphone will not function properly. There are various methods to secure the diaphragm to the charge plate and the diaphragm to the housing. The connection between the charge plate and diaphragm provides mechanical support and is sometimes referred to as a "stitch", due to its shape. The connection between the diaphragm and housing provides mechanical support and an air-tight seal around the perimeter of the diaphragm. Various attempts have been made to provide mechanical support and an air-tight seal, but these attempts have various shortcomings.

BRIEF DESCRIPTION OF THE DRAWINGS

For a more complete understanding of the disclosure, reference should be made to the following detailed description and accompanying drawings wherein.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Approaches are provided herein that allow elements of an acoustic device to be attached together. In particular, a stitch, typically comprised of epoxy, is used to hold a charge plate and a diaphragm and to, in the absence of sound energy, maintain a constant or substantially constant distance between these elements.

Approaches are provided herein that allow elements of an acoustic device to be acoustically sealed. In particular, sealing material, typically comprised of epoxy, is applied around the perimeter of a diaphragm to create an air-tight seal around its perimeter.

In one advantage of the present approaches, a stitch or other securing device can be made of a smaller size and this allows for smaller microphones and more available back volume; hence, more microphone sensitivity is provided. This is particularly advantageous for situations where the microphone needs to be as small as possible (e.g., in portable electronic devices and hearing aid applications).

In another advantage, consistently sized and shaped stitches are obtained. This allows for less variation in the available back volume of microphones; hence, less sensitivity variation of the microphone.

The present approaches also provide for increased mechanical strength than adhesive only stitches, specifically amongst its motor components. This allows for better mechanical performance when mechanical shocks impact the microphone.

The present approaches also provide for reduced vibration sensitivity capability. In other words, the thickness of the stitch can be increased more precisely than with epoxy only stitches, which reduces vibration sensitivity.

In still another advantage of the present approaches, manual epoxy stitch "artistry" requirements are eliminated. In other words, operator dependency is alleviated; thus, less variation in the sensitivity of the microphone.

In many of these embodiments, a motor includes a diaphragm and a charge plate. The diaphragm is separated from the charge plate by a constant distance. The separation is secured using a stitch that is constructed from a b-stage epoxy bonded to a polyimide layer, such as Kapton (manufactured by Dupont corporation).

Figure 1:
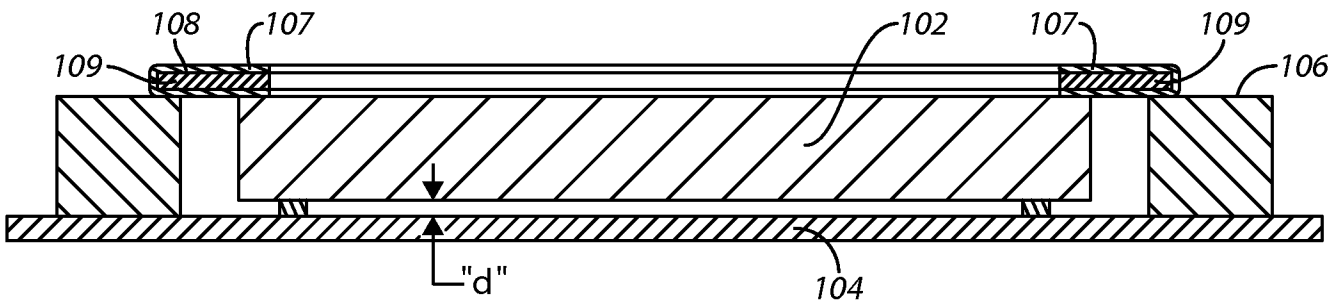
FIG. 1 comprises a side cutaway view of an ECM showing a stitch according to various embodiments of the present invention.
Figure 2:
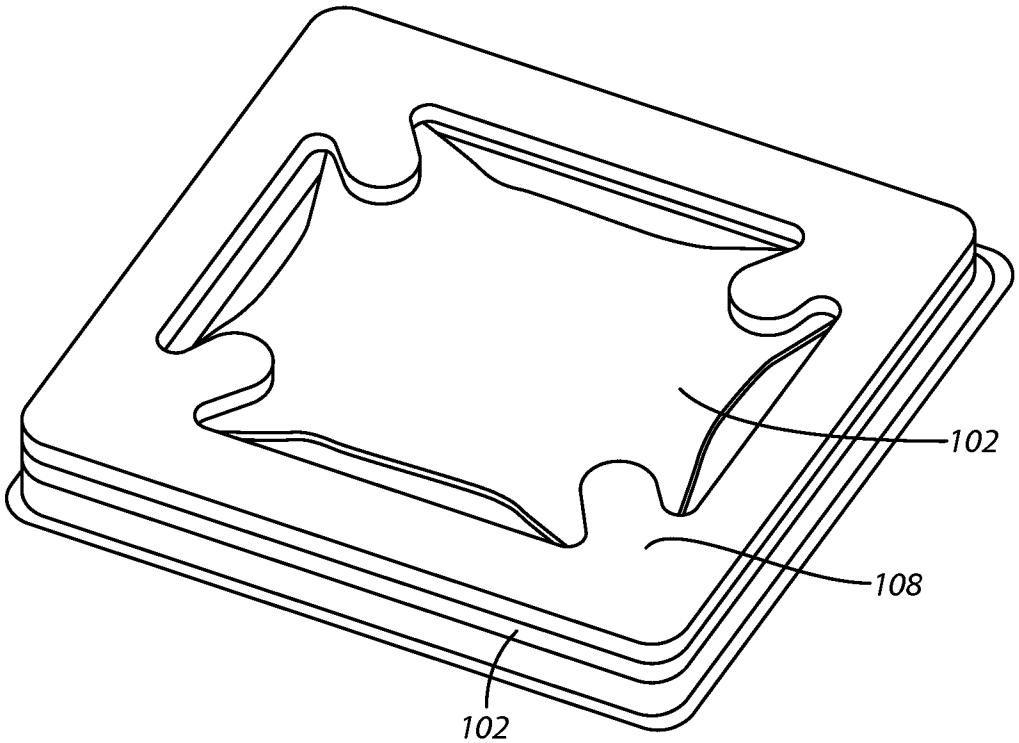
FIG. 2 comprises a perspective view of an ECM with a stitch according to various embodiments of the present invention.

Referring now to FIG. 1 and FIG. 2, and acoustic apparatus 100 is described. In this example, the acoustic apparatus is a motor for an ECM. The apparatus 100 includes a charge plate 102, a diaphragm 104, a diaphragm ring 106, and a stitch 108. In this example, these components are together referred to as an ECM motor.

The charge plate 102 is a conventional charge plate that is used in ECMs and the diaphragm 104 is a conventional diaphragm (e.g., a film material) used in ECM devices. The ring 106 secures the diaphragm 104. The charge plate 102 and diaphragm 104 are separated by a distance "d." In the absence of sound energy, this distance d is maintained to be a constant distance or a nearly constant distance.

The stitch 108 is, in one example, constructed of "b-stage" epoxy 107 backed with a polyimide film 109. The polyimide (e.g., Kapton) film remains stable in a wide range of temperatures (e.g., from approximately −273 to approximately +400 degrees C.). The polyimide gives the b-stage epoxy a more sturdy mechanical structure, which makes for ease of shape designing, cutting, and handling with reduced risk of breakage and shape deformation. The b-stage epoxy bonds to the charge plate and adjacent diaphragm ring 106 to secure the motor.

The b-staged epoxy used in the stitch 108 is a semi-solid form of partially cured epoxy. It is used between (e.g., midway between) the liquid state of blended, but partially cured resins, and a final state of a fully formed polymer. "B-stage" epoxy has been heat cured for a short period of time and then cooled (quenched) to prevent complete polymerization of the resin system. As discussed elsewhere herein, this midway solid state can expand manufacturing options. B-stage epoxy can be provided in a number of options such as in rolls or sheets.

With the epoxy having been partially cured (e.g., less than approximately 10 percent), it is available for bonding parts together (i.e., the charge plate and diaphragm). In other words, the epoxy and its polymerization are "staged" in order to facilitate the overall process. Later, the epoxy is re-heated to reactivate polymerization and complete the curing cycle.

In this way, and as compared with other approaches, the blending/depositing process (blending of resin and hardener, then depositing the liquid on a substrate) is separated from the curing process (after the liquid is deposited, immediately curing the liquid with time or heat) thereby adding flexibility to the manufacturing process.

In one example of the operation of the system of FIGS. 1 and 2, sound energy enters through a sound port in a microphone assembly (not shown) and vibrates the diaphragm 104 and this action creates a corresponding change in electrical potential (voltage) between the diaphragm 104 and the charge plate 102. In the absence of the sound energy, the diaphragm 104 is separated from the charge plate 102 by the constant or nearly constant distance d. The separation is secured using a stitch 108 to provide mechanical strength and to ensure that the distance is maintained.

This voltage represents the sound energy that has been received. Typically, the voltage is then transmitted to an electric circuit (e.g., an integrated circuit such as an application specific integrated circuit (ASIC)). Further processing of the signal may be performed on the electrical circuit. For instance, amplification or filtering functions may be performed on the voltage signal at the integrated circuit.

Figure 3:
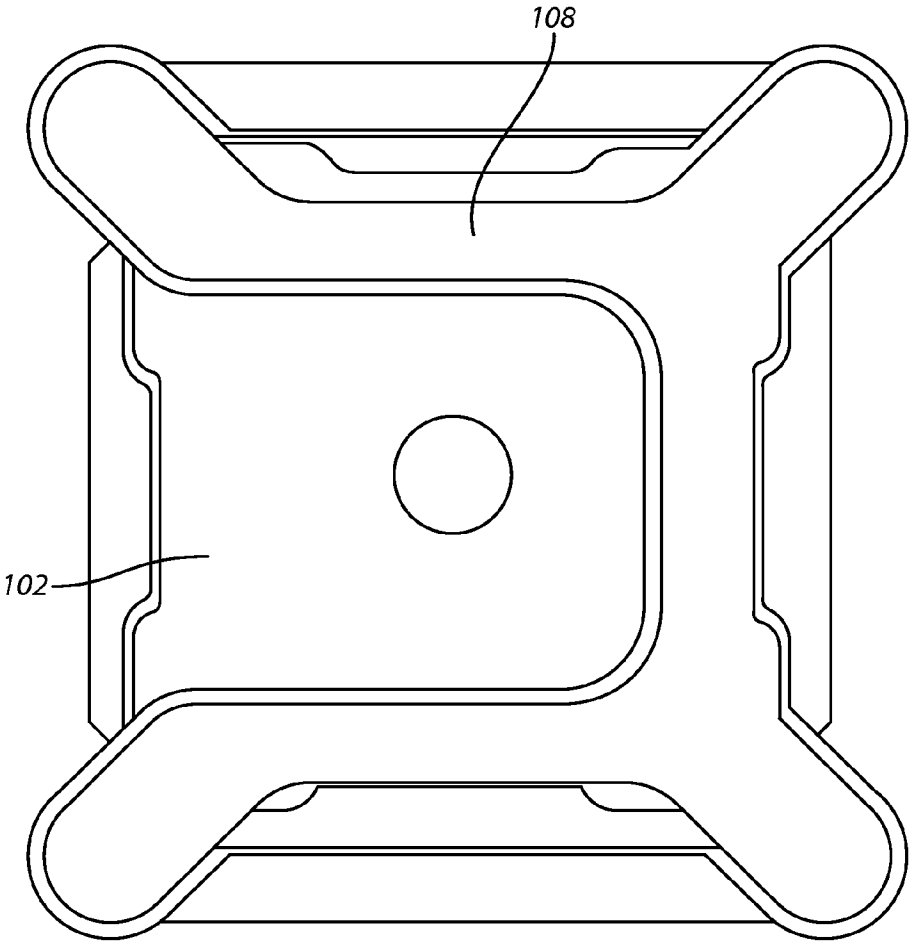
FIG. 3 comprises a top view of an ECM with a stitch according to various embodiments of the present invention.

Referring now to FIG. 3, another example of a stitch that is shaped differently from the example of FIGS. 1 and 2 is described. The elements of FIG. 3 are the same as those in FIGS. 1 and 2 so that their descriptions are not repeated here. FIG. 3 illustrates that stitches can take on a number of different shapes and dimensions.

Figure 4:
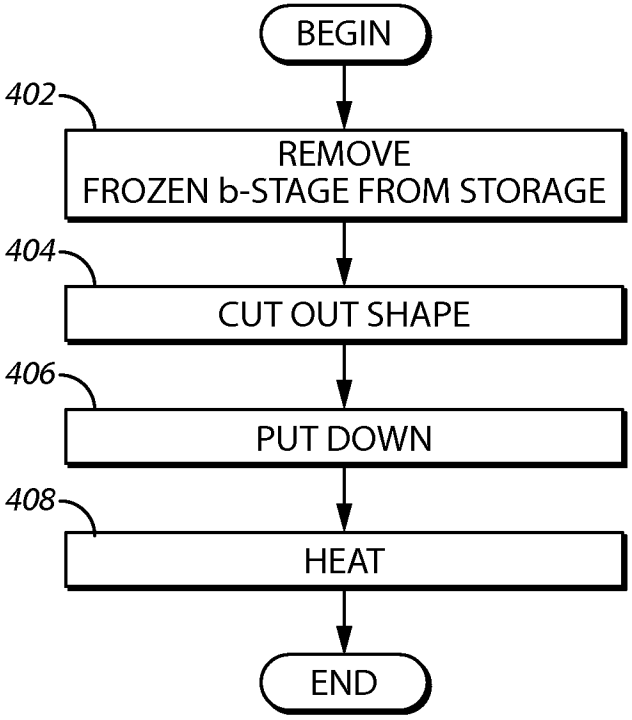
FIG. 4 comprises a flow chart for making an ECM with a stitch according to various embodiments of the present invention.

Referring now to FIG. 4, one example of a method for making an ECM microphone with a stitch is described.

At step 402, the b-stage epoxy/polyimide (e.g., Kapton) assembly is removed from frozen storage. The assembly is kept frozen prior to use to prolong its life by decelerating cure and to make it easier to handle, as it is not as tacky in the frozen or chilled state. At step 404, the shape of the stitch is cut out which can be accomplished using a conventional die stamping process or by using a laser cutting process.

At step 406, the epoxy/polyimide (e.g., Kapton) stitch is put down over the charge plate and diaphragm ring, bridging the gap between them, and tacking their position. At step 408, the epoxy/polyimide (e.g., Kapton) stitch and its adjacent components (charge plate and diaphragm ring) are put in an oven and heated (e.g., at 90 degrees Celsius) for approximately two hours whereas, the oven process renders the stitch attached to the diaphragm and the charge plate, and they are removed from the oven.

In this example, the epoxy/polyimide film assembly functions as a mechanical support; however, it will be appreciated that the principles described herein can also be applied to other functions, such as creating an air tight seal around the perimeter of the microphone diaphragm.

In this example, the device is a microphone; however, it will be appreciated that the principles described herein can also be applied to other types of devices, such as armature balanced receivers.

Preferred embodiments of this invention are described herein, including the best mode known to the inventors for carrying out the invention. It should be understood that the illustrated embodiments are exemplary only, and should not be taken as limiting the scope of the appended claims.

What is claimed is:

1. A Electret Condenser Microphone (ECM) motor apparatus comprising:
- a diaphragm ring support structure, the diaphragm ring support structure defining an opening therethrough;
- a charge plate disposed within the opening;
- at least one stitch coupling the diaphragm ring support structure to the charge plate;
- a diaphragm disposed adjacent to and in a generally parallel relationship to the charge plate;
- at least one spacer separating the charge plate and the diaphragm, the at least one spacer being spaced from the diaphragm ring support structure and disposed between the charge plate and the diaphragm;
- wherein the at least one stitch fastens the charge plate to the diaphragm ring support structure, and
- wherein the charge plate and the diaphragm have a constant or nearly constant distance between the charge plate and the diaphragm in the absence of sound energy.

2. The ECM motor apparatus of claim 1 wherein the at least one stitch has a first layer and a second layer.

3. The ECM motor apparatus of claim 2 wherein the first layer comprises a polyimide, and the second layer comprises a B-staged epoxy.

4. The ECM motor apparatus of claim 1 wherein the at least one stitch is four stitches.

5. The ECM motor apparatus of claim 4 wherein the four stitches are configured in the same shape.

6. A method of manufacturing an Electret Condenser Microphone (ECM) motor apparatus including a charge plate, a diaphragm, and a diaphragm ring support structure, the method comprising:
- positioning the charge plate within the diaphragm ring support structure wherein there is a gap between the charge plate and the diaphragm ring support structure;
- applying a stitch to the charge plate and to the diaphragm ring support structure wherein the stitch bridges the gap; and
- curing the stitch by applying heat to the stitch.

7. The method of claim 6 wherein applying the stitch includes positioning a multi-layer stitch material on a portion of the diaphragm ring support structure and on a portion of the charge plate wherein the multi-layer stitch material bridges the gap.

8. The method of claim 6 wherein applying the stitch includes applying a multi-layer stitch material, the multi-layer stitch material comprising a polyimide and a B-staged epoxy.

9. The method of claim 6 wherein applying the stitch includes applying four stitches.

10. The method of claim 9 wherein the applying four stitches includes applying four stitches configured in the same shape.

11. The method of claim 6 further comprising:

providing a fixed space between the charge plate and the diaphragm in the absence of an acoustic input signal.

12. The method of claim 11 wherein providing the fixed space includes separating the charge plate and the diaphragm with a spacer spaced apart from the diaphragm ring support structure.

13. A Electret Condenser Microphone (ECM) motor apparatus comprising:

a diaphragm ring support structure, the diaphragm ring support structure defining an opening therethrough;

a charge plate disposed within the opening;

a stitch coupling the diaphragm ring support structure to the charge plate at four connection regions, the stitch being generally u-shaped in configuration;

a diaphragm disposed adjacent to and in a generally parallel relationship to the charge plate;

wherein the charge plate and the diaphragm have a constant or nearly constant distance between the charge plate and the diaphragm in the absence of sound energy.

14. The ECM motor apparatus of claim 13 wherein the stitch has a first layer and a second layer.

15. The ECM motor apparatus of claim 14 wherein the first layer comprises a polyimide, and the second layer comprises a B-staged epoxy.

16. The ECM motor apparatus of claim 13, wherein in the presence of sound energy, the diaphragm vibrates and an electrical potential between the diaphragm and the charge plate is changed.

17. The ECM motor apparatus of claim 1, wherein in the presence of sound energy, the diaphragm vibrates and an electrical potential between the diaphragm and the charge plate is changed.

* * * * *